United States Patent [19]

Kratz et al.

[11] 4,091,608

[45] May 30, 1978

[54] TIMER CLOCK

[75] Inventors: Bernhard Kratz, Nuremberg; Erwin Potthof, Rothenbach, Peg, both of Germany

[73] Assignee: Firma DIEHL, Nuremberg, Germany

[21] Appl. No.: 784,508

[22] Filed: Apr. 4, 1977

[30] Foreign Application Priority Data

Apr. 13, 1976 Germany ..... 2616248

[51] Int. Cl.[2] ..... G04F 3/02

[52] U.S. Cl. ..... 58/22.9; 58/85.5; 58/39.5; 200/35 R; 58/21.13

[58] Field of Search ..... 58/85.5, 21.14, 21.13, 58/22.9, 22.5, 7, 39.5, 39, 125 B, 126 A; 200/35 R, 35 H, 37 R

[56] References Cited

U.S. PATENT DOCUMENTS

| | | | |
|---|---|---|---|
| 2,620,872 | 12/1952 | Wyman | 58/39.5 |
| 2,864,443 | 12/1958 | Niemand | 58/21.13 X |
| 2,973,659 | 3/1961 | Gallagher et al. | 58/22.9 X |
| 3,431,720 | 3/1969 | Ehner et al. | 58/22.9 |
| 3,534,545 | 10/1976 | Oster et al. | 58/22.9 X |
| 3,941,000 | 3/1976 | Allison | 58/21.13 X |
| 4,020,625 | 5/1977 | Mahon et al. | 58/21.13 |

*Primary Examiner*—Ulysses Weldon

*Attorney, Agent, or Firm*—Burns, Doane, Swecker & Mathis

[57] ABSTRACT

A timer clock of the type having a time-of-day recording mechanism, a switch electrically connectible to an electric device, an adjustable timer wheel for controlling the switch, and a power source operably connected to drive said time-of-day recording mechanism and the timer wheel. The wheel has a first set of teeth defining a second timing period which is more extended than the first timing period. The power source includes a motor and a drive shaft driven by the motor. The drive shaft carries a first gear adjacent one end thereof for actuating the second set of teeth. The first gear is engageable with the second set of teeth to drive the timer wheel during the second timing period. The timer wheel carries gearing for actuating the switch at the end of a timing cycle. The drive shaft carries a pinion engageable with a second gear, the latter comprising part of the time-of-day recording mechanism. The pinion carries drive teeth adjacent said one end of the drive shaft for driving the first set of teeth during the first timing period, preceeding the driving of the second set of teeth by the first gear. The drive shaft is mounted at its other end, opposite the one end, in a manner permitting swinging movement of the one end relative to the timer wheel.

19 Claims, 8 Drawing Figures

TIMER CLOCK

BACKGROUND AND OBJECTS

The invention relates to a timer clock for timing an operation such as oven cooking and for recording of the time of day, including means for adjustment and readout which makes possible the selective adjustment of an unextendedly or extendedly shown switching-on period.

Such timer clocks or switch clocks are known per se. Thus, for example, a timer clock for ovens has been known, where an area of a scale, with an unextendedly shown switch-on time extends on a scale starting out from a zero point to one side, while starting out from the zero point toward the other side, a range of scale with an extendedly shown switch-on time extends. By an "unextended" time period is meant one which is marked in infrequent increments, such as hourly increments, while an "extended" time period refers to one which is marked at more frequent increments, such as one minute increments, for example. A separate area of scale with an extendedly shown time period of, for example, 5 to 10 minutes is required in case of this clock, because in an unextendedly shown range of the scale, which for example, comprises 2 hours, neither an exact reading nor a possibility of fine adjustment of only a few minutes is possible in the scale sector of the last minute. The user of a timer clock, however, wants to know exactly at the end of the cooking process, how long the cooking process should yet continue. He additionally also requires a possibility of exact adjustment for short cooking processes of a few minutes. Therefore, a separate range of the scale with an extendedly shown switch-on duration must be provided. A disadvantage of timer clocks of this type therefore is the impossibility of adjusting and reading, in the last section of the scale of the last minutes of the switch-on time of the unextended range of the scale, a precise duration of time. Another disadvantage lies in the operation of this timer, which forces the user to adjust either only a short but relatively precise switch-on time or to relinquish a precisely adjustable and readable switch-on time and instead the program in the area of the last minute of the switch-on time a precisely adjustable and readable switch-on time.

The drive for the adjusted switch-on takes place in that case, in connection with the extendedly shown switch-on time, via a first release clutch and a separate gear. The drive for the extendedly shown switch-on time takes place via a second separate release clutch and another gear. The drive of the time of day mechanism is accomplished separately via a third gear.

Therefore, the object of the invention is to create a simple and inexpensive timer clock, suitable for mass production, which makes possible a precise and reproduceable adjustment of the reading and switching even in the area of the last minute of an extended switching-on time, whereby the switch clock should be easily operable.

BRIEF SUMMARY

According to the invention this task is accomplished through the fact that the driving shaft is mounted so that a free end thereof may swing freely. The driving shaft is provided at the end with a gear developed as a pinion. The pinion, besides carrying the toothing for the extendedly recorded switch-on time, serves both as a carrier of a toothing for cooperation with an additional gear as well as a carrier for a step-up means for the unextendedly recorded starting time. A wheel has been provided, which may be engaged with the pinion and which serves not only as a carrier for at least two toothings for starting times recorded extendedly and unextendedly, succeeding each other alternatingly over a part of the periphery of the wheel, but also as the carrier of at least one switching organ for a control switch.

One development of the invention consists in that a mounted end of the driving shaft is fixed by means of a fixed bearing and is driven at this end by the motor. The free end of the driving shaft is swingable against the force of a spring. The free end of the driving shaft carries a pinion attached rigidly therewith, and carries toothing for driving the time of day recording mechanism. The wheel serves as a carrier of adjusting means and the switching organ serves for the operation of an assigned switch.

Advantageous further developments of the invention consist in that the wheel serves simultaneously also for the extendedly and unextendedly recorded switch-on time. The switching organ of the wheel is formed by a cam. The wheel serves as the carrier of an additional switching organ, e.g., for an alarm element. An additional toothing is disposed on said wheel, which becomes effective to switch off the alarm. An advantageous embodiment of the invention is to be seen in the fact, that the swingable end of the shaft is guided in a slot, which is formed in a slider, whereby the swivelable end of the shaft is under the pressure of a spring by means of the slider in the direction of the wheel. An advantageous further development of the invention consists in the fact that the pinion is developed as a bearing for the switch means for an unextendedly recorded switch-on time. In a further development of the invention, the switching means for the unextendedly recorded switch-on time consists of a third toothing of the pinion, whereby this third toothing is developed as a cardioid. According to one embodiment of the invention, the setting of the switch-on time and the adjustment of the clock-time is accomplished by only one pinion by direct engagement of said pinion with the corresponding toothings.

The timer clock of the invention thus has a range of the scale, starting from zero, with an extendedly shown switch-on time of 10 minutes, for example, which is followed by a scale range with an unextendedly shown switch-on time of for example, several hours. In case of the switch clock of the invention, in case of every termination of the switch-on cycle, the range of the scale with the extendedly shown switch-on time must be passed through. The user therefore, by adjustment by means of an adjusting button in one direction will be able to read a short operating time of a few minutes very precisely and the user also has the possibility in case of setting of a switch-on time of several hours toward termination of this time, therefore in the area of the last minutes of this adjusted time, to determine exactly, when the cooking process is finished. Because of the construction according to the invention and of the assignment of various gear means for the extendedly shown range of the scale or for the unextendedly shown range of the scale, one may not only achieve a high degree of precision in reading, but also just as great precision of adjusting and switching.

This switch clock offers a simplified operation by adjusting short times or longer times in one direction. It is secured against faulty operation by a properly developed toothing. The drive shaft, driven continuously by a motor is subjected to only slight wear at its swingable end as the result of a corresponding development of a slider. The timer clock of the invention, as compared to the status of the prior art, makes do with considerably fewer construction units, thus there is a saving of two slide couplings, considerably fewer gears are used, and it is possible on the basis of the construction of the invention, to compensate for errors in relation of individual gears, so that lesser demands may be made of the production tolerances of these gears. The timer clock of the invention for driving its recording of the time of day and for the switch-on time merely requires one shaft, driven by the motor. On the basis of the decrease of the required parts and their complete production from plastic, a decrease of the dimensions of the switch clock as compared to former switch clocks is possible.

THE DRAWINGS

The invention will be explained in more detail on the basis of preferred embodiments and of drawings.

Figure 2:
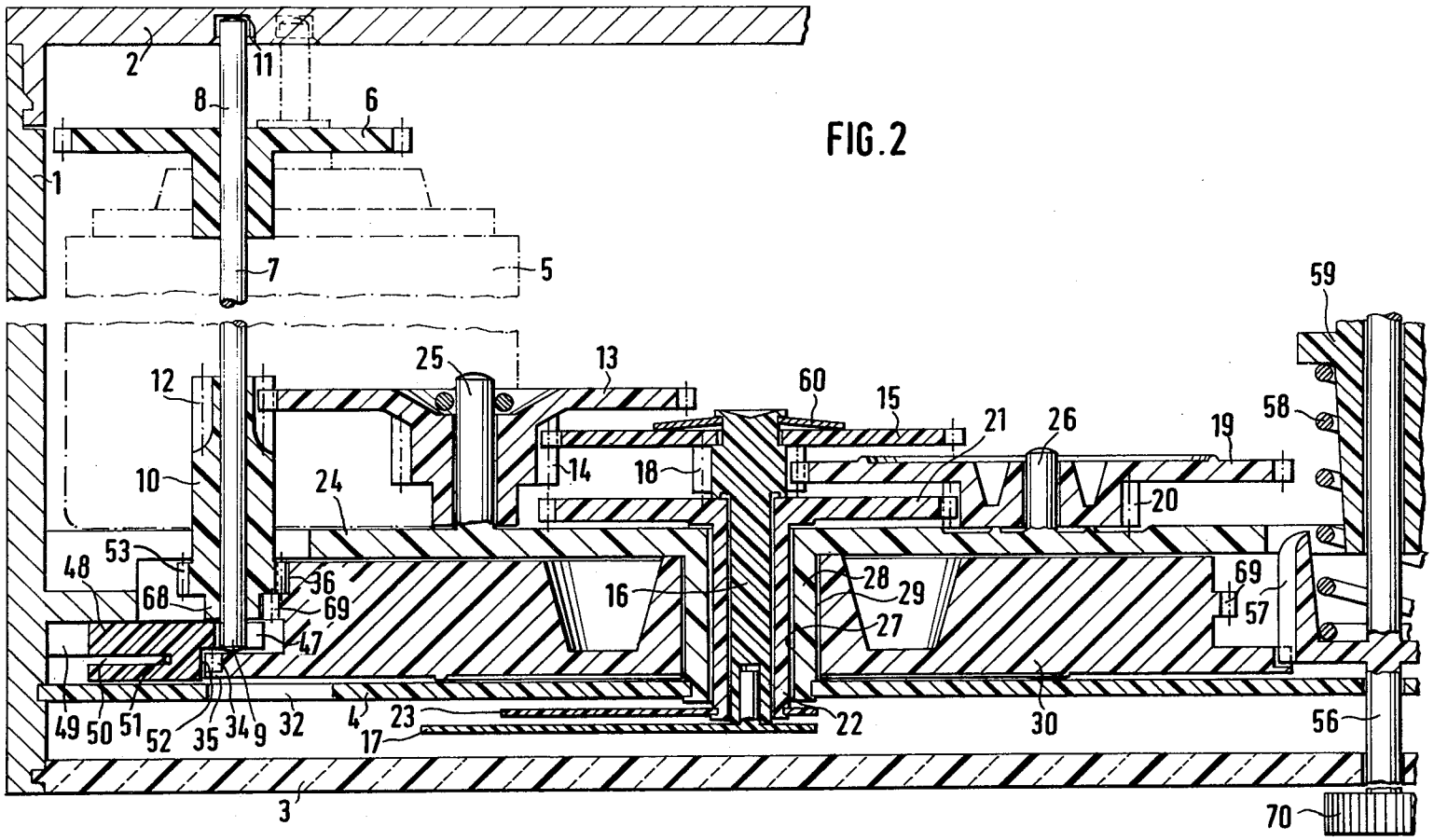
FIG. 2 shows another embodiment of the switch clock of the invention in section.

FIGS. 4, 5, 6, 7, and 8 show by increments, the switching process of the switch clock of the invention depicted in FIG. 2.

DETAILED DESCRIPTION

Figure 1:
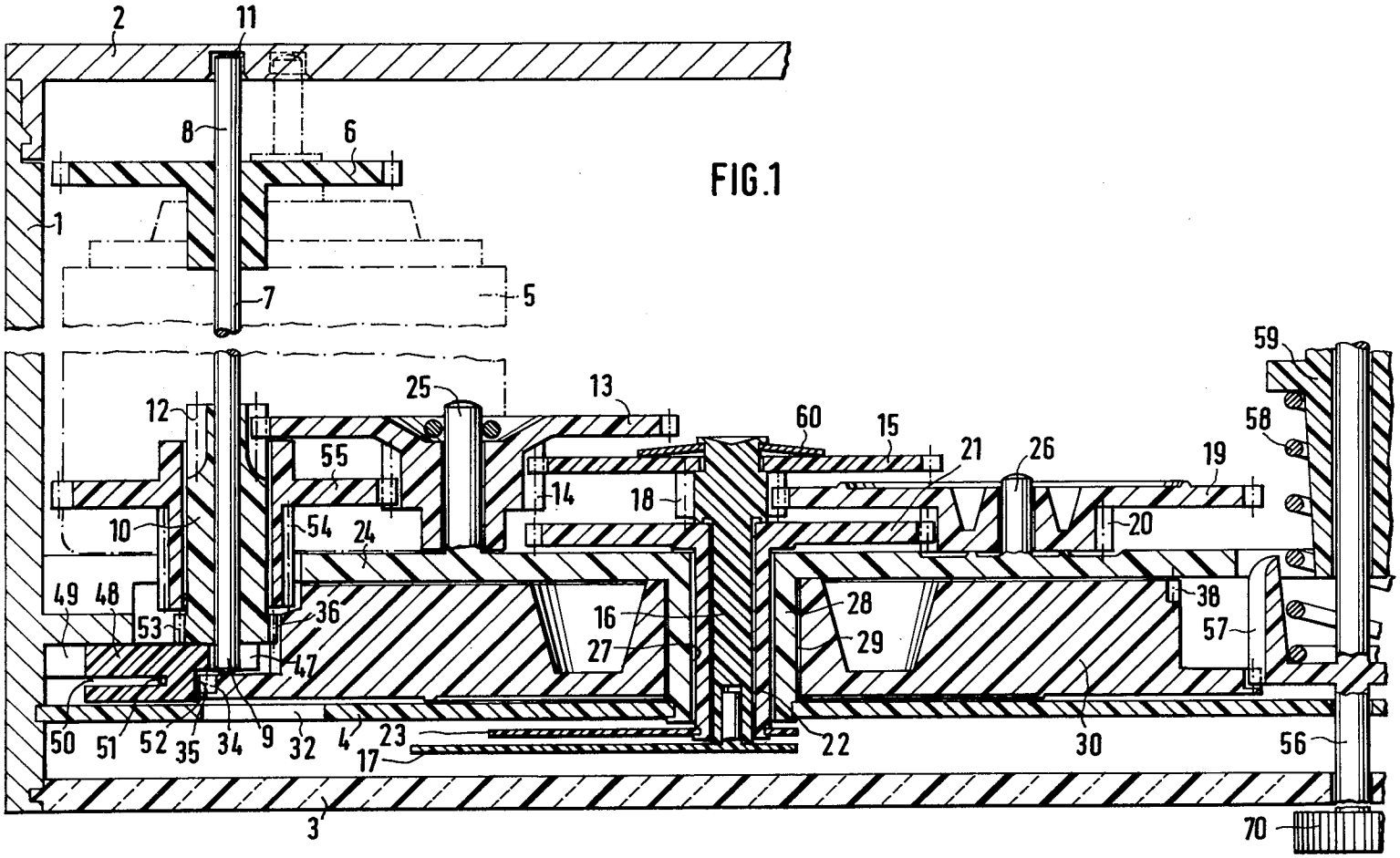
FIG. 1 shows an embodiment of the switch clock of the invention in section.

FIG. 1 shows a first embodiment of the timer clock of the invention in section. A housing 1 is closed in its rear by a rear wall 2 and in its front by a transparent front pane 3. Behind the front pane 3, a disc 4 for the face of the clock has been inserted into the housing. The housing 1, the rear wall 2, the transparent front pane 3 and the disc 4 for the scale of the clock, may at the same time be made for example, of plastic.

A motor 5 is mounted in the housing 1, which has been shown in broken lines in FIG. 1. The driven pinion of this motor is always engaged with a gear 6 by means of the gearing not shown, which gear 6 is attached rigidly at the one end 8 of a driving shaft 7. The other end 9 of the drive shaft 7 carries a pinion 10, likewise attached rigidly at this end. The one end 8 of the drive shaft 7, at the same time, is mounted in the rear wall 2 of the housing by means of a fixed bearing 11. The other end 9 of the drive shaft 7, on the contrary, is free and able to swing, as will yet be described in more detail later on.

The pinion 10 has a toothing 12 for the recording of the time of day. The toothing 12 is engaged by a gear 13 of the time recording gear mechanism. The gear 13 has a pinion 14, which meshes continuously with the gear 15. The gear 15 in turn is seated on the minute shaft 16, which carries a minute recorder 17. A pinion 18, connected to gear 15, is continuously in engagement with a gear 19, meshes with a gear 21. This gear 21 is seated on an hour tube 22, which in turn carries an hour hand 23. The time recording gear mechanism is thus made up by the gear 13 with its pinion 14, the gear 15 and the pertinent pinion 18, for the minute drive as well as by the gear 19 with its pinion 20 and the gear 21 for the hour drive.

All components of the gear drive may, for example, be made of plastic.

The gear 13 and its pinion 14 are mounted on a peg 25, and the gear 19 with its pinion 20 on a peg 26, whereby the pegs 25 and 26 are attached to a bedplate 24 on the housing side. These pegs may be produced in one piece of plastic for example, by way of injection molding techniques together with the bedplate on the housing side.

The hour tube 22 and inside the hour tube 22, the minute shaft 16 are likewise mounted in the bedplate 24 on the housing side, whereby the inside 27 of a hollow shaft 28 in turn is developed in one piece with the bedplate 24 on the housing side.

A gear 30 is mounted on the outside 29 of the hollow shaft 28. The gear 30 is the carrier of a whole series of functions and organs, which are to be shown subsequently. The gear 30, as bearer of a recording scale 31 (FIG. 3), is developed for the recording or adjustment of the extendedly recorded switch-on time and of an unextendedly recorded switch-on time. As is clear from FIG. 3, the range of the scale for the extendedly recorded switch-on time may extend from zero to ten minutes. The area of the unextendedly shown switch-on time which may for example, be several hours, follow directly after the area of the extendedly shown switch-on time. The recording scale 31 is visible through the adjusting window 32, which is located in the disc 4 for the clock scale. The reading of the recording scale 31 is accomplished by means of an adjusting marker 33 which is attached to the window 32.

Furthermore, the gear 30 has a radially outwardly stepped portion developed as a carrier for adjusting means 34, whereby said adjusting means 34 is disposed on the entire circumference of the wheel 30. The adjusting means 34 may be formed for example, by a toothing, which is disposed on the extreme periphery 35 of the wheel 30. Naturally, any other suitable means may also be used for the adjustment of the wheel 30. For example, the adjustment may also be accomplished, after proper development of the wheel 30, by friction wheels.

In addition, the wheel 30 is developed as bearer of at least two mutually spacially and angularly displaced toothings, whereby these toothings, following each other alternately, are disposed over a part of the periphery of wheel 30. As becomes clear from FIGS. 1 and 3, there is a first toothing 36 on the periphery of wheel 30, which extends over an angle 37. The toothing 36 serves for the adjustment and step by step action for an extendedly recorded switch-on time. The toothing 36 thus corresponds to the increments of the recording scale 31 and, to be sure, to the area for the extendedly recorded switch-on time. The range of the extendedly recorded switch-on time is variable, depending on how large an angle 37 is maintained, over which the toothing 36 extends. Consequently, the range of the scale for an extendedly recorded switch-on time may be optimally adapted to the pertinent requirements of the users of the switch clock.

In addition, the wheel 30 carries a second toothing 38, which is likewise attached to the periphery of wheel 30 and which extends for example, over an angle 39. The angel 39 too, and thus the toothing 38 for an unextendedly recorded switch-on time may be varied arbitrarily, depending on angle 39, so that for example, an unextendedly recorded switch-on time of one, two, three or more hours may be achieved. The toothing 38 again serves for adjusting and step by step action for the range of the switch-on time not shown, whereby the toothing 38 corresponds to the increments of the range of scale of the unextendedly recorded switch-on time of the recording scale 31.

Finally, the wheel 30 is also developed as bearer of at least one switching organ 40. The switching organ 40 is developed as a cam, but any other suitable form may also be used as a switching organ. The switching organ, at the same time, is attached to the inner periphery of the wheel 30. Additionally, the wheel 30 serves as bearer of an additional switching organ 41. The additional switching organ 41 is likewise disposed on the inside periphery of the wheel 30, and may, for example, be developed as a cam. However, any other suitable embodiments may also be used for the additional switching organ 41. Both the switching organ 40 as well as the additional switching organ 41 is scanned radially, always by one feeler 42 or 43, under spring tension, the two feelers 42 and 43 directly operate the switches 44 or 45. The circuit of the cooking plate or of a broiler may be switched on and off by switch 44, while the switch 45 is used for the operation of an alarm, for example, by optical or accoustic recording of the termination of the cooking or broiling process.

Naturally, the scanning of the switching organ 40 or 41, developed as a cam, may not only be accomplished radially but also axially. Also, the scanning may not only be made mechanically, but an electric scanning may be possible for example, by applying an electrically conductive coating on the cam, which is interrupted by electrically non-conductive sections, whereby the scanning is then made electrically. The two switches 44 and 45 may not only serve for the connecting of electric circuits, but it may also operate purely mechanical switches, so that the use of the switch clock does not remain limited to electric devices.

The wheel 30 still has a third toothing 46 beside the two toothings 36 and 38, which is disposed on the outside periphery of the wheel 30. This third toothing is likewise displaced spatially and angularly in relation to toothing 36 or 38, and is disposed over a part of the periphery of the wheel 30 as well. The function of toothing 46 will be explained later in more detail. The wheel 30 is developed in one piece with the toothings 36, 38 and 46, the adjusting toothing 34, the switching organ 40 and the additional switching organ 41 and the recording scale 31. It may for example, be made of plastic and by way of injection molding. The recording scale 31, at the same time, is correspondingly formed into the wheel 30 or applied by means of a pressure process. Naturally, the scale may also be sprayed on, or may be developed on wheel 30 in some other way.

The method of operation of the embodiment of the invention shown in FIGS. 1 and 3, will now be explained in more detail. The motor 5 drives the gear 6 via a reduction gear, not shown, and thus continuously drives the drive shaft 7. The shaft 7 serves on the one hand for the drive of the recording for the time of day and on the other hand for the drive of the switch clock. For the purpose of driving the time of day recording, the pinion 10 attached to the shaft 7, is provided with a toothing 12. The time of day recording continuously meshes with the toothing 12. It is made as a transmission gear and consists of gears 13, with its pinion 14 and the gear 15 for driving the minute hand, and of the pinion 18, the gear 19 with its pinion 20 and the gear 21 for driving the hour hand.

For the drive of the switch clock, the drive shaft 7 is fixed with its end 8 in the fixed bearing 11 with sufficient clearance, in order to permit a swiveling of the other end of the shaft 9 of the drive shaft. The bearing 11 may therefore have a slightly conical opening.

The end of the drive shaft 7 is mounted radially swivelably in a long hole or slot 47. This long hole 47 is formed by a slidable plate or slider 48 which is guided in a guide 49. The slider 48 has a slit 50 in which a spring 51 is disposed. The spring 51 is supported by the housing 1, and presses the slider 48 in the direction of the wheel 30 against the radially swivelable end 9 of the drive shaft 7. A section 52 is molded on to the slider 48, which is disposed directly opposite the extreme periphery 35 of the wheel 30.

A type of toothing was selected for the toothing 12 of the time of day recording, which is insensitive to changes of axial distance, as might occur by swinging of the shaftend gaud of the pinion 10, firmly connected with it. Therefore, the toothing 12 is made as an involute toothing, but any other suitable toothing may also be selected. The pinion 10 has beside the toothing 12, an additional toothing 53 which may be brought into engagement with the toothing 36 for the extendedly recorded switch-on time of the wheel 30. The toothing 53 thus serves for step by step switching of the extendedly recorded switch-on time. Finally, the pinion 10 is still developed as bearer of a step by step action means for the unextendedly recorded switch-on time. The step by step action means for the unextendedly recorded switch-on time consists of a pinion 54 and a gear 55 firmly connected with the former. The pinion 10 is formed as a bearing for the step by step action means, comprising the pinion 54 and the gear 55, for an unextendedly recorded switch-on time. The pinion 54 thus glides loosely on the pinion 10. The pinion 54 and the gear 55 at the same time are made of one piece. The step by step action means is continuously engaged by means of its gear 55 with the pinion 14 of the time recording gear mechanism, belonging to the gear 13. The pinion 54 of the step by step action means is disposed on pinion 10, such that it may be brought into engagement with the toothing 38 for the unextendedly recorded switch-on time of the wheel 30.

The setting of the switch-on time is accomplished in case of the switch clock of the invention by direct engagement of an adjusting pinion with gear 30, which bears toothing 36 and 38 for the extendedly and unextendedly recorded switch-on time. The adjusting pinion for the adjustment of the switch-on time of the timer serves simultaneously for the adjustment of time of day recording. A shaft 56 and thus an adjusting pinion 57 is turned via an adjusting knob 70. On the basis of the pressure of a spring 58, which is supported by the guide 59 on the housing side, adjusting pinion 57 is continuously engaged with the adjusting means 34 of the wheel 30, whereby the adjusting means comprises an all-around toothing on the extreme periphery 35 of the wheel 30. By pressing the shaft 56 against the force of the spring 58, the adjusting pinion 57 may be made to engage with the gear 19 of the time recording gear mechanism. The shifting of the time of day recording then takes place in the customary manner by means of gear 19 and pinion 18. In order that a shifting be possible despite the gear connection to the motor, the gear 15 is connected with the pinion 18 merely by means of a friction disc 60.

In case of the timer clock of the invention, it is thus possible, to accomplish both adjusting processes directly with only one adjusting shaft or one adjusting pinion, instead of the customary two adjusting devices, one for the switch-on time and the other for the shifting time of day recording.

The adjustment of a switch-on time of only a few minutes and of several hours is accomplished by direct shifting of the wheel 30 with the help of the adjusting pinion 57, whereby the adjustment of the short as well as the long times is accomplished by turning of the adjusting shaft. The normal adjusting process takes place in the run-off direction 62, see FIG. 3. However, it is also possible to make the adjustment of the wheel 30 counter to the run-off direction, but in that case a considerably greater force must be applied. The adjustment of a switch-on time in the run-off direction is possible, because the pinion 54 and the toothing 53 and the toothing 36, 38 and 46 as well are always equipped with a dog toothing, which is easily adjustable whenever the obtuse angle of the dog toothing is used in the adjustment. The dog toothing, however, is designed such that a twisting of the wheel 30 is possible counter to the run-off direction 62 of the wheel 30 for adjustment, without tearing out the teeth. It is true, that as considerably greater expenditure of force during adjusting counter to the run-off direction 62 must be exerted than in the run-off direction 62. This difficient operation, just described, of the adjustment of a switch-on time counter to the run-off direction of the wheel 30 will be without consequences, because the flanks of the teeth of the dog toothing are not exactly perpendicular to the run-off direction which is at the same time the direction of transfer of power, but for example, a 20° angle is still missing for these flanks to stand vertically.

The possibility of direct adjustment described of the switch-on time through the wheel 30 may be carried out only because the end of the drive shaft 7 and thus the pinion 10, firmly connected with said end 9 of the shaft, or its toothing 53 and its pinion 54 are mounted radially swivelable. Therefore, in case of the adjusting process, the end 9 of the shaft may be forced away from the wheel 30 counter to the force of the spring 51 by the toothings of the wheel 30. This swivelable axle, which already rotates since it also serves for the recording of the times of the day, makes thus an adjustment possible without the otherwise need slipping clutches for the pinion 54 or the toothing 53. The pinion 54 and the toothings 53,36,38 and 44 may not only be made as dog toothing but also in any other suitable type of toothing. The torque, transferable during the "coming into engagement" of the previously mentioned gears and toothings is determined by the elastic force of the spring 51 acting radially in relation of the drive shaft 7. The transferable torque may be designed variably in and counter to the run-off direction 62 by the proper inclination of the flanks of the teeth of the dog toothing.

Subsequently, the run-off process of an adjusted switch-on time of for example, 60 minutes is described. In this span of time of the unextendedly recorded switch-on time of 60–10 minutes, the toothing 38 engages with the pinion 54. The pinion 54 starts the switch gear 30 at a lower speed than the drive shaft 7, the reduction of the speed is accomplished from the toothing 12 for the recording of the time of day via the gear 13 with its pinion 14 to the gear 55, which is connected in one piece with the pinion 54. The pinion 54 drives the gear 30 at this rpm, which is reduced in comparison to the drive shaft 7, until the toothing 38 on the periphery of wheel 30 ends. While the last tooth of the toothing 38 is still engaged with one tooth of the pinion 54, now the first tooth of the toothing 36 of the wheel 30 already comes to be engaged with a tooth of the toothing 53 of the pinion 10. This phase of transition from the unextendedly recorded switch-on time to the extendedly recorded switch-on time, to which always the toothings 38 or 36 are assigned, is shown in FIGS. 1 and 3. There is an angle 63 between the last tooth of the toothing 38 and the first tooth of the toothing 36 of the wheel 30. This angular distance between the two toothings is significant, in order to ensure the best possible transition between the moving-out-of-engagement of the pinion 54 with the toothing 38 and getting-into-engagement of the pinion 54 with the toothing 38 and the coming-into-engagement of the toothing 53 with the toothing 36. On the basis of the swiveling axle 9 of the invention and of the pinion 54 respectively of the toothing 53, which thus is likewise swivelable, any hooking together or blocking during transition from one toothing to the other need not be feared, since the shaft may escape resiliently. By providing the angle 63 between the two toothings 38 and 36 an unnecessary slipping out or a repeated swinging in of the pinion 10 will be avoided.

After the coming-out-of-engagement of the toothing 38 and of the pinion 54 for an unextendedly indicated switch-on time, the toothing 36 of the wheel 30 then comes directly into engagement with the toothing 53 of the pinion 10. The toothing 36, which extends over the angle 37, serves for the adjustment and step by step action of the extended recorded switch-on time which extends for example, from 10 to zero minutes. The two toothings 38 and 36 are not made variably. That is, in case of both toothings, always the same number of teeth are disposed over the same angle. However, if the toothing 36 is engaged with the toothing 53 of the pinion 10, then the wheel 30 nevertheless rotates faster, since the pinion 10 with its toothing 53 revolves considerably faster than the pinion 54 driven via the reduction gear 13,14 and 55.

The wheel 30, as compared to the extendedly shown switch-on time, at the same unit in time, for example, ten minutes, passes through a greater stretch. As a result, the switch-on time is recorded extendedly. Since the number of teeth of the toothings 38 and 36 are always the same, in case the angle of expansion is the same, not only the precision of reading of the recording scale 31 in the range of the extendedly recorded switch-on time, but also the precision of adjustment will be increased. Thus, in case of the toothing 38 for the unextendedly recorded switch-on time, between 20 and 10 minutes, four teeth have been disposed, i.e., a step by step adjustment at a distance of 2½ minutes is possible. After transition to the toothing 36, in case of the same angle of expansion, which now extends between the 10th and the 9th minutes, likewise four teeth have been disposed, so that a time adjustment at the 15 seconds interval will be possible. This precision of time setting has a corresponding precision of switching.

The wheel 30 is conveyed by the toothing 53, until the toothing 36 is at an end. Since, after there is no longer any toothing 36, the periphery of the wheel 30 decreases by the height of the tooth, the end 9 of the drive shaft 7 and thus also the pinion 10 is pushed radially in the direction of the wheel 30 by the force of the spring 51, which engages via the slider 48 on the shaft 9, The slider 48 pushes the end of the shaft, however, in the direction of the wheel 30 only by a certain path, whereby said path corresponds to the distance between the part 52 of the slide and the outermost periphery 35 of the wheel 30. By supporting the slider 48 with its section 52 on the outermost periphery 35 of the wheel 30, said wheel 30 intercepts the pressure of the spring 51. The end 9 of the drive shaft 7 as a result, has free clearance in the long hole 47, since it has been freed of both pressure of spring 51 and engagement with the toothings of the wheel 30 as well. As a result of this measure of the invention a considerable lowering of wear will be achieved at the mounting of the end 9 of the shaft, which is of importance because the shaft 7 is continuously driven by the motor, since it serves simultaneously for the operation of the recording of the time of day. For an undisturbed swinging of the driving axle 7 it is merely necessary to design the tip clearance of the toothing 12 such, that the drive can take place smoothing. The pinion 10, the drive shaft 7 and gear 6 in this case are made of one piece and for example, made of plastic. The end 9 of the shaft, swivelable against the force of the spring 51, makes it also possible to avoid the disadvantages of a fixed mounting of this end of the shaft. Thus, the errors in revolving which develop as a result of the relatively large wheel 30 during engagement of the pertinent toothings of the wheel 30 with the corresponding toothing of the pinion 10 or of the pinion 54, are balanced out by the elastic yielding of the end 9 of the shaft. Thus, not only two slipping clutches for the engagement with the extendedly and the unextendedly recorded switch-on time are omitted, but considerable costs are also saved because greater tolerances in the production are permissible and a perfect functioning of the switch clock is nevertheless guaranteed.

In case of an adjusted switch-on time for example, of one hour, the timer of the invention must, in case of the run-off or run-down process, per force pass through the range of the scale for the extendedly recorded switch-on time. The wheel 30, in this case, is driven at low speed in the area of the unextendedly shown switch-on time and at a higher speed in the area of the extendedly shown switch-on time. The variable speed of the wheel 30 results only from the variable reduction ratio between toothing 53 and pinion 54. This reduction ratio is designed such, that the step by step switching means, which consists of gear 55 and pinion 54 is reduced for the unextendedly recorded switch-on time to the toothing 53 for the extendedly recorded switch-on time in the ratio unextendedly to extendedly recorded switch-on time. However, an embodiment can be provided where the toothings 36 and 38 are used for the formation of the total reduction ratio between unextendedly and extendedly recorded switch-on time.

The switching organ 40, developed as a cam is disposed on the inner periphery of the wheel 30 such that the sensor 42 of the switch 44 is in a recess 64 in case the timer is switched off, i.e., the switch 44 is opened, so that the appliance supplied via the switch 44 is dead. In case of an adjusting process, the sensor 42 is lifted out of the recess 64 by twisting the wheel 30 and as a result, the switch 44 or the circuit served by it is closed. After termination of the switch-on time, i.e., whenever the zero mark of the recording scale 31 is in front of the adjusting marker 33, the sensor 42 of the switch 44 will just be in the first part 65 of the descending cam path. As an immediate consequence, the switch 44 is opened. At this time, the toothing 36 and the additional toothing 53 of the pinion 10 have already gotten out of engagement. At the peripheral point 61 of the wheel 30, there is no longer any toothing, so that the wheel 30 may rotate freely. Since the sensor 42 of the switch 44 is pressed onto the cam path by the force of a spring, the pressure exerted by the sensor 42 on the transversely declining cam path causes a continued rotation of the wheel 30 in the run-off direction 62 until the sensor 42 has reached the bottom of the recess 64. As a result of this previously described continued rotation of the wheel 30, with an already opened switch 44, the pinion 54 becomes engaged with the toothing 46.

The additional switching organ 41 likewise developed as a cam path, which serves for the operation of an alarm, has been disposed on wheel 30 such, that the switch 45 is open during the entire switch-on time. At the end of the switch-on time, therefore, whenever the zero is in front of the adjusting mark 33, the sensor 43, pressing as a result of spring power on to the cam path, drops into the recess 66. The switch 45 is closed and thus the alarm is operated, which may be of either an optical or accoustic type. The previously described process of the coming-into-engagement of the pinion 54 with the toothing 46, after switching off of the consumer by the switch 44, now serves for bringing about an end to the alarm signal, delivered by the closed switch 45. The continuously driven pinion 54, therefore continues to rotate the wheel 30 in the direction 62 of revolution, until the toothing 46 terminates. As a result, the cam path of the additional switching organ 41 is still rotated, so that the sensor 43 of the switch 45 is lifted out of the recess 66. As a result, the switch 45 is again opened per force, and thus an end to the delivered alarm signal is brought about. After termination of the toothing 46, the peripheral point 67 of the wheel 30, which has no toothing at all will be in front of the pinion 54, so that the pinion 10 is no longer in engagement with wheel 30. The toothing 46 thus constitutes an alarm shut-off toothing.

Another embodiment of the switch clock of the invention is shown in cut in FIG. 2. In case of this other embodiment of the invention shown in FIG. 2, parts which are identical to those in the first embodiment were given the same reference numbers. The embodiment shown in FIG. 2, differs from the one shown in FIGS. 1 and 3 merely by a differently constructed step up switching means of the pinion 10 for the unextendedly recorded switch-on time as well as a correspondingly adapted toothing of the wheel 30. All other methods of functioning, parts, production and construction characteristics described according to FIGS. 1 and 3 are also valid for the embodiment as in FIG. 2 and will therefore not be described again.

Figures 3, 4, 5, 6, 7, 8:
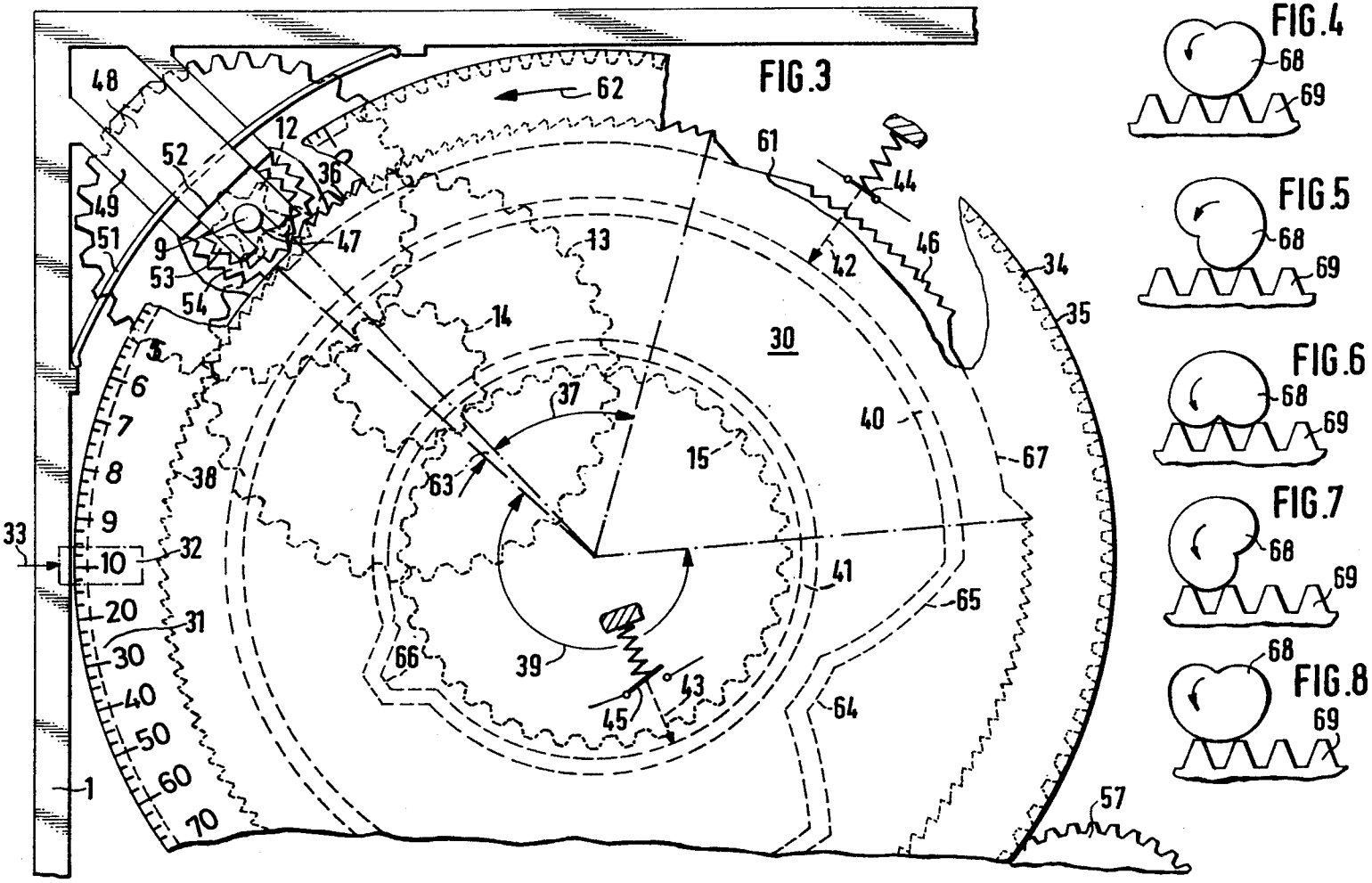
FIG. 3 shows a front view of the switch clock of the invention in FIG. 1, omitting the time of day recording face and hands.

The step up switching means 54, 55 for the unextendedly switch-on time of the first embodiment shown in FIGS. 1 and 3, is omitted in case of the second embodiment as in FIG. 2. The pinion 10 in the embodiment of FIG. 2 has, just as before, a first toothing 12 for the time of day recording and another toothing 53 for the step up action of the extendedly recorded switch-on time. The step up switching means for the unextendedly recorded switch-on time in case of this second embodiment is produced as the third toothing 68 of the pinion 10. The third toothing 68 of the pinion 10 at the same time is developed as a cardioid, as can be seen from FIGS. 4–8. The pinion 10 and the toothing 12 for the time of day recording, the toothing 53 for the extendedly recorded switch-on time and the toothing 68, made as a cardioid, for the unextendedly recorded switch-on time are made of one piece. The third toothing 68, executed as a cardioid cooperates with a correspondingly adapted toothing 69 of the wheel 30. The toothing 53 for the extendedly recorded switch-on time of the pinion 10 engage, just as before with the same toothing 36 of the wheel 30 as in case of the first embodiment. Merely the local position of the toothings 53 and 36 on the pinion 10 or the wheel 30 has been shifted. Even in case of the embodiment of FIG. 2, the reduction ratio between the unextendedly and extendedly recorded switch-on time remains as in the case of the first embodiment. Therefore, the step up switching means, developed as the third toothing 68, for the unextendedly recorded switch-on time is reduced in relation to the toothing for the extendedly recorded switch-on time in the ratio unextendedly to extendedly recorded switch-on time. Thus, the precision of adjusting and reading as well as switching of the first embodiment is also maintained in case of the second embodiment. The step up switching process for the unextendedly recorded switch-on time in the embodiment of FIG. 2 is shown in FIGS. 4–8. The third toothing 68 of pinion 10 developed as a cardioid, is driven continuously by the motor by way of the drive shaft 7. As can be seen from FIGS. 4, 5, 6, 7 and 8, in case of a complete revolution of cardioid 68, the toothing 69 of the wheel 30 is stepped up by one tooth as long as the toothing 69 is in engagement with the cardioid. The toothing 69 extends at the same time over the same angle 39 on the periphery of the wheel 30, as does the corresponding toothing 38 in case of the first embodiment of the FIGS. 1 and 3. As had already been mentioned in the beginning all other step up switching processes take place, as they had been described in the embodiment of FIGS. 1 and 3.

It will be realized that the preferred timer clock of the invention has a time of day recording mechanism, one or more switches 44, 45 electrically connectible to an electric device such as an oven, an adjustable timer mechanism for controlling the switches, and a power source for driving the time of day recording mechanism and the timer mechanism. The timer mechanism includes a rotatably mounted wheel which has a first set of teeth 38 or 69 and a second set of teeth 36 therebehind. The first set of teeth forms a first or unextended time period and the second set of teeth 36 forms a second or extended time period. The power source includes a motor 5 and a drive shaft 8. The drive shaft 8 at one end 9 carries a first gear 53 for actuating the second set of teeth 36. The wheel carries one or more cam paths 40, 41 for actuating the switches at the end of a timing cycle. The drive shaft 8 carries a pinion 10 which is engageable with a second gear 13 which comprises part of the time of day recording mechanism.

The pinion also carries drive means (54,55—FIG. 1 or 68—FIG. 2) for driving the first set of teeth (38 or 69) preceeding the driving of the second set of teeth 36. The drive shaft 8 is mounted at end 7 thereof in a manner which permits swinging movement of the free end 9 thereof relative to the wheel.

The major advantages of the invention have been discussed earlier and will be only briefly reviewed by observing that a single drive shaft is employed to drive both the timer wheel and the time of day recording mechanism. The swingable mounting of the drive shaft enables the timer wheel to be adjusted even as the drive shaft continues to drive the time of day recording mechanism. This swingable mounting also minimizes wear at the end 9 of the drive shaft. Actuation of the timer is simplified since rotation of only one wheel in one direction is required which provides the user with an unextended timing period for long timing durations, and/or a precisely readable extended timing period for short timing durations. In both instances, the last stages of the timing duration may be precisely observed.

Although the invention has been described in connection with a preferred embodiment thereof, it will be appreciated by those skilled in the art that additions, modifications, substitutions and deletions not specifically described may be made without departing from the spirit and scope of the invention as defined in the appended claims.

What is claimed is:

1. In a timer clock of the type having a time-of-day recording mechanism, switch means electrically connectible to an electric device, adjustable timer means for controlling said switch means, and power means operably connected to drive said time-of-day recording mechanism and said timer means; said timer means having means defining a first timing period and means defining a second timing period which is more extended than said first timing period, said power means including a motor and a drive shaft driven by said motor; said drive shaft carrying first gear means adjacent one end thereof for actuating said second timing period defining means; the improvement wherein:

said timer means comprises a rotatably mounted wheel, said first and second timing period defining means comprising, respectively, a first set of circumferentially arranged teeth on said wheel and a second set of circumferentially arranged teeth on said wheel following said first set of teeth;

said first gear means being engageable with said second set of teeth to drive said wheel during said second timing period;

said wheel carrying means for actuating said switch means at the end of a timing cycle;

said drive shaft carries a pinion engageable with a second gear, the latter comprising part of said time-of-day recording mechanism;

said pinion carrying drive means adjacent said one end of said drive shaft for driving said first set of teeth during said first timing period, preceeding the driving of said second set of teeth by said first gear means;

said drive shaft being mounted at its other end, opposite said one end, in a manner permitting swinging movement of said one end relative to said wheel.

2. A timer clock according to claim 1, wherein said other end of said drive shaft is mounted in a swivel bearing, said drive shaft being driven adjacent said other end by said motor; a spring being arranged to bias said one end of said drive shaft in the direction of said wheel; said pinion being rigidly connected with said drive shaft; and means for manually rotating said wheel to adjust the timing cycle.

3. A timer clock according to claim 1, wherein said wheel carries a marked scale indicating said first and second timing period, said second timing period having more frequent increment markings than said first timing period.

4. A timer clock according to claim 1, wherein said means for actuating said switch means comprises a cam path on said wheel engageable with said switch.

5. A timer clock according to claim 1, wherein said wheel includes an outwardly stepped portion, the outer periphery of which carries adjustment toothing extending completely circumferentially therearound to accommodate manual rotary adjustment of said wheel.

6. A timer clock according to claim 5, including a displaceable adjustment gear shiftable between a first position in engagement with said adjustment toothing to adjust the timing cycle, and a second position in engagement with part of said time-of-day recording mechanism to adjust the time-of-day recording.

7. A timer clock according to claim 4, including a second switch means connectable to an alarm, said wheel carrying a second cam path on said wheel engageable with said second switch means.

8. A timer clock according to claim 7, wherein said wheel carries an alarm shut-off toothing following said second set of teeth; said alarm shut-off toothing being engageable with said pinion at a point when said second switch means actuates an alarm, so that said wheel and said second cam path are rotated to open said second switch means and shut-off the alarm.

9. A timer clock according to claim 1, including a slidably mounted plate, said plate including a slot which receives said one end of said drive shaft for free movement therein.

10. A timer clock according to claim 9, wherein said slidable plate is guided for reciprocable movement within a guide; a spring urging said plate against said one end of said drive shaft and in the direction of said wheel.

11. A timer clock according to claim 9, wherein said plate includes a surface disposed opposite a radially outermost peripheral surface of said wheel.

12. A timer clock according to claim 1, wherein said drive means for driving said first set of teeth comprises third gear means freely rotatably carried by said pinion.

13. A timer clock according to claim 12, wherein said third gear means comprises a one-piece gear having a driven toothing engageable with a portion of said time-of-day recording mechanism and a drive toothing engageable with said first set of teeth on said wheel.

14. A timer clock according to claim 1, wherein said drive means for driving said first set of teeth comprises a cardioid shaped gear carried by said pinion.

15. A timer clock according to claim 14, wherein said pinion and said cardioid gear are of integral one-piece construction.

16. A timer clock according to claim 1, wherein said means for driving said first set of teeth drives the latter at a more rapid rate than said means for driving said second set of teeth drives the latter.

17. A timer clock according to claim 1, wherein said pinion and said first gear means being of integral, one-piece construction.

18. A timer clock according to claim 1, including a main drive gear mounted adjacent said other end of said drive shaft and being operably connected to said motor; said main drive gear, said drive shaft, and said pinion being of integral one-piece construction.

19. A timer clock according to claim 8, wherein said wheel carries adjustment toothing enabling manual rotary adjustment thereof, and a recording scale indicative of the timing cycle; said wheel, said first and second set of teeth, said alarm shut-off toothing, said adjustment toothing, said first-named and second cam paths, and said recording scale being of integral one-piece construction.

* * * * *